US010618711B2

(12) United States Patent
Weir

(10) Patent No.: US 10,618,711 B2
(45) Date of Patent: Apr. 14, 2020

(54) TAMPER-EVIDENT CLOSURE

(71) Applicant: Obrist Closures Switzerland GmbH, Reinach (CH)

(72) Inventor: Allison Weir, New Cumnock (GB)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 15/779,950

(22) PCT Filed: Nov. 29, 2016

(86) PCT No.: PCT/EP2016/079075
§ 371 (c)(1),
(2) Date: May 30, 2018

(87) PCT Pub. No.: WO2017/093218
PCT Pub. Date: Jun. 8, 2017

(65) Prior Publication Data

US 2018/0354689 A1 Dec. 13, 2018

(30) Foreign Application Priority Data

Dec. 2, 2015 (GB) ..... 1521303.6
Mar. 2, 2016 (GB) ..... 1603600.6
Mar. 16, 2016 (GB) ..... 1604499.2

(51) Int. Cl.
*B65D 55/02* (2006.01)
*B65D 41/34* (2006.01)
*B65D 49/02* (2006.01)

(52) U.S. Cl.
CPC ..... *B65D 55/026* (2013.01); *B65D 41/34* (2013.01); *B65D 49/02* (2013.01); *B65D 2101/0069* (2013.01); *B65D 2101/0084* (2013.01)

(58) Field of Classification Search
CPC ..... B65D 55/026; B65D 41/34; B65D 49/02; B65D 2101/0069; B65D 2101/0084
(Continued)

(56) References Cited

U.S. PATENT DOCUMENTS 2,201,205 A * 5/1940 Samburg ..... B65D 55/026 215/230
2,414,420 A * 1/1947 Sebell ..... B65D 55/12 215/252

(Continued)

FOREIGN PATENT DOCUMENTS

CN 104203767 A 12/2014

*Primary Examiner* — Benjamin R Shaw
(74) *Attorney, Agent, or Firm* — Lightbulb IP, LLC

(57) ABSTRACT

A tamper-evident closure (101) comprises a first portion (105, 106) and a second portion (102, 104) comprising a window (103) through which a view of the first portion (105, 106) is visible. The second portion (102, 104) is rotated relative to the first portion (105, 106) upon first opening of the tamper-evident closure (101), from a first position in which the first and second portions (105, 106; 102, 104) are in a first relative relation and a first view of the first portion (105, 106) is visible through the window (103), to a second position in which the first and second portions (105, 106; 102, 104) are in a second relative relation and a second, different view of the first portion (105, 106) is visible through the window (103). A locking mechanism irreversibly locks the first and second portions (105, 106; 102, 104) in the second relative relation.

14 Claims, 10 Drawing Sheets

(58) Field of Classification Search
USPC ..... 222/153.01
See application file for complete search history.

(56) References Cited

U.S. PATENT DOCUMENTS 2,939,597 A * 6/1960 Greene ..... B65D 55/026 215/230
3,484,819 A * 12/1969 Tanner ..... B65D 49/04 222/147
4,440,306 A * 4/1984 Van Buskirk ..... B65D 55/02 215/230
4,446,979 A * 5/1984 Gach ..... B65D 55/026 215/203
4,591,062 A * 5/1986 Sandhaus ..... B65D 51/1638 206/459.1
4,603,785 A * 8/1986 Gach ..... B65D 55/066 215/230
4,723,673 A * 2/1988 Tartaglia ..... B65D 55/026 215/230
4,736,857 A * 4/1988 Monico, Jr. ..... B65D 55/026 215/230
5,115,929 A * 5/1992 Buono ..... B65D 50/041 215/216
5,188,251 A * 2/1993 Kusz ..... A61J 7/04 116/308
5,299,701 A * 4/1994 Barker ..... A61J 7/04 215/216
5,544,770 A * 8/1996 Travisano ..... B65D 55/026 206/807
5,884,788 A * 3/1999 Wilde ..... B65D 41/045 215/230
6,257,430 B1 * 7/2001 Rinnie ..... B65D 35/44 215/230
6,336,453 B1 * 1/2002 Scarrott ..... A61M 15/009 128/200.23
8,453,856 B2 * 6/2013 Skelton ..... B65D 55/022 215/230
2010/0264108 A1 * 10/2010 Baban ..... B65D 55/022 215/220
2012/0138563 A1 * 6/2012 Brumfield ..... B65D 51/18 215/230
2014/0183195 A1 * 7/2014 McPherson ..... B65D 49/04 220/266
2016/0159536 A1 * 6/2016 Pucci ..... B65D 55/026 215/230

* cited by examiner

TAMPER-EVIDENT CLOSURE

FIELD OF THE INVENTION

The present invention relates generally to a closure for a container neck, and more particularly to a tamper-evident closure with means for indicating that the closure has been opened at least once.

BACKGROUND OF THE INVENTION

There is an increasing demand for tamper-indicating systems which ensure that a container is not re-filled with non-original contents. Whilst it is relatively easy to produce some form of tamper-evidence, it is much more difficult to provide a closure with tamper-evidence which cannot be either overcome without causing the tamper-evidence system to activate, or activated and then returned to a virtually visually identical state so as to appear non-activated.

A particularly useful method of providing tamper-evidence is to use a system in which a closure is initially located in a first position, but once removed can only be returned to a second position which is visually distinct from the first. Such tamper-evident systems are only effective if they cannot be reversed. For example, in systems which use an obstructing member to hold two parts apart it is possible to cut the obstruction to allow a gap to be closed.

International Patent Publication Nos. WO 2005/049443 and WO 2006/117505 describe closures which generate a gap upon first opening of the closure to indicate that the closure has been opened at least once. The closures generate unobstructed gaps following relative rotation of one part with respect to another. In other words, two parts of the closure are held apart without the requirement of an obstruction. The closures are provided with some internal mechanism for preventing the two parts from being rotated back to their original relative positions.

International Patent Publication No. WO 2014/170284 describes a closure comprising a shell having a distortable portion that is distorted upon first opening of the closure to indicate that the closure has been opened at least once.

It is an object of the present invention to provide further improvements relating to a closure for a container neck.

SUMMARY OF THE INVENTION

The present invention provides a tamper-evident closure that changes appearance during first opening, the change in appearance indicating that the tamper-evident closure has been opened at least once.

According to a first aspect there is provided a tamper-evident closure for a container neck, the tamper-evident closure comprising: a first portion, and a second portion comprising a window through which a view of the first portion is visible; the second portion rotatable relative to the first portion upon first opening of the tamper-evident closure, in a first direction of rotation, from a first position in which the first and second portions are in a first relative relation to a second position in which the first and second portions are in a second relative relation; and a locking mechanism for irreversibly locking the first and second portions in the second relative relation; rotation of the second portion relative to the first portion causes rotation of the window relative to the first portion, a first view of the first portion is visible through the window when the first and second portions are in the first relative relation, and a second, different view of the first portion is visible through the window when the first and second portions are in the second relative relation; whereby the view of the first portion through the window of the second portion is irreversibly changed during first opening of the tamper-evident closure.

This change in the view of the first portion that can be seen through the window of the second portion provides an effective tamper-evident feature.

The first view may comprise a first colour presentation and the second, different view may comprise a second, different colour presentation. Any combination of colours may be used. Additionally or alternatively to colour, alphanumeric text, graphics, patterns, pictures, surface finishes and/or textures may be used to provide or contribute to the changing view.

During first opening of the tamper-evident closure, the locking mechanism irreversibly locks the first portion and the second portion in the second relative relation and thereafter the first and second portions may be removable together.

The second portion may comprise a shell in which the window is defined. The shell may comprise a top plate and a side skirt and the window may be defined in the side skirt.

The shell may comprise a metal material. The shell may comprise aluminium.

The window may be an aperture or a cut-out.

The first portion may comprise a sleeve comprising a first zone having a first appearance and a second zone having a second appearance that differs from the first appearance.

The sleeve may comprise a metal material. The sleeve may comprise aluminium. The sleeve may or may not have a continuous perimeter.

The locking mechanism may comprise a ratchet arrangement. The ratchet arrangement may be a lateral ratchet arrangement.

The locking mechanism may comprise an inner ratchet element and an outer ratchet element, the first portion may comprise the inner ratchet element and the second portion may comprise the outer ratchet element.

The tamper-evident closure may comprise a first part, and a second part, when the first and second portions are in the first relative relation, prior to first opening of the tamper-evident closure, the first and second parts may be adjacent one another, and when the first and second portions are moved into the second relative relation, during first opening of the tamper-evident closure, an irreversible gap may be generated between the first and second parts.

The first and second parts may be lower and upper shell parts.

The gap may be unobstructed.

The first portion may be removably engageable with a body portion for fixing to a container neck. The first portion may be removably engageable with a container neck.

The body portion may comprise a pouring fitment. The pouring fitment may comprise a non-return valve.

The window may comprise more than one opening.

The first portion may comprises a second window, rotation of the second portion relative to the first portion may cause rotation of the first window and the second window relative to the first portion, a first view of the first portion may be visible through the second window when the first and second portions are in the first relative relation, and a second, different view of the first portion may be visible through the second window when the first and second portions are in the second relative relation. The first view through the first window and through the second window may be the same or different from each other. The second, different view through the first window and through the second window may be the same or different from each other.

According to a second aspect there is provided a container neck provided with a tamper-evident closure according to the first aspect.

Different aspects and embodiments of the invention may be used separately or together without departing from the scope of the invention as defined by the appended claims.

BRIEF DESCRIPTION OF THE DRAWINGS

The present invention will now be more particularly described, with reference to the accompanying drawings, in which.

DESCRIPTION

Example embodiments are described below in sufficient detail to enable those of ordinary skill in the art to embody and implement the apparatus, systems and processes herein described. It is important to understand that embodiments of the invention can be provided in many alternate forms and the invention should not be construed as limited to the examples set forth herein but by the scope of the appended claims.

The present invention provides a tamper-evident closure for a container neck. The tamper-evident closure comprises a first portion, and a second portion comprising a window through which a view of the first portion is visible. The second portion is rotatable relative to the first portion upon first opening of the tamper-evident closure, in a first direction of rotation, from a first position in which the first and second portions are in a first relative relation to a second position in which the first and second portions are in a second relative relation. The tamper-evident closure further comprises a locking mechanism for irreversibly locking the first and second portions in the second relative relation. Rotation of the second portion relative to the first portion causes rotation of the window relative to the first portion. A first view of the first portion is visible through the window when the first and second portions are in the first relative relation, and a second, different view of the first portion is visible through the window when the first and second portions are in the second relative relation. The view of the first portion through the window of the second portion is irreversibly changed during first opening of the tamper-evident closure. This change in the view of the first portion that can be seen through the window of the second portion provides an effective tamper-evident feature. The change in the view that is visible through the window may be a change in colour.

Figure 1:
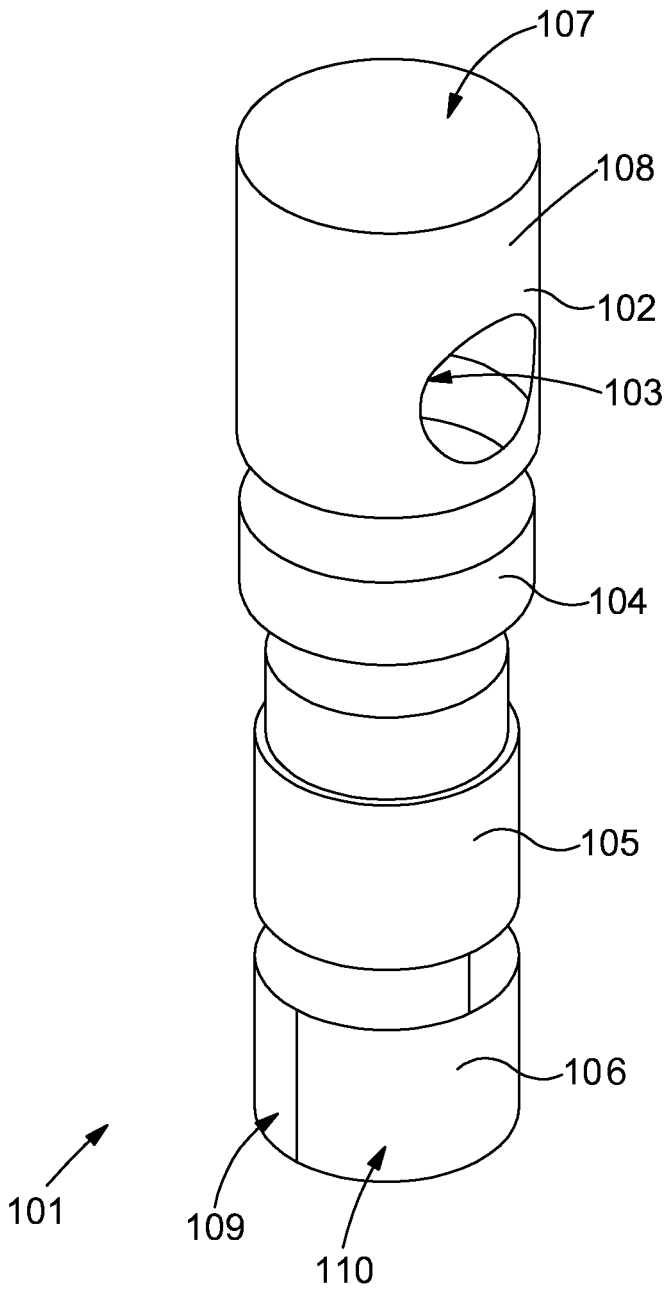
FIG. 1 shows an exploded schematic view of components of a tamper-evident closure.

An exploded schematic view of components of a tamper-evident closure 101 is shown in FIG. 1. In this embodiment, the tamper-evident closure 101 has a substantially circular cross-sectional shape.

Tamper-evident closure 101 comprises a shell 102 in which a window 103 is defined, an outer component 104, an inner component 105 and a sleeve 106. In this example, the shell 102 comprises a top plate 107 and a side skirt 108, and the window 103 is defined in the side skirt 108.

In the present example, the window 103 is an aperture. In an alternative example, the window is a cut-out. It is therefore to be understood that the window may or may not have a continuous boundary edge that defines a closed shape. In this specific example, the window 103 is a substantially circular aperture; however an aperture or cut-out may have any suitable shape. Furthermore, the window may comprise more than one aperture or cut-out or a combination thereof. The window may comprise a single opening or a plurality of openings, which may be openings in a mesh-like arrangement or in the form of slots or slits.

In this example also, the sleeve 106 comprises a first zone 109 having a first appearance and a second zone 110 having a second appearance that differs from the first appearance of the first zone 109. In an alternative example, the sleeve 106 comprises more than two zones with different appearances. It is to be appreciated that regions of first and second zones that are immediately adjacent each other or that are spaced apart may be visible through the window before and after first opening of the tamper-evident closure. In this example, the sleeve 106 has a continuous perimeter. In an alternative example, the sleeve does not have a perimeter that forms a closed shape. The sleeve may thus be provided by an annular collar or a strip, which may have a pre-formed profile, or may be formable into a profile, suitable for application to or incorporation within another component.

Figure 2:
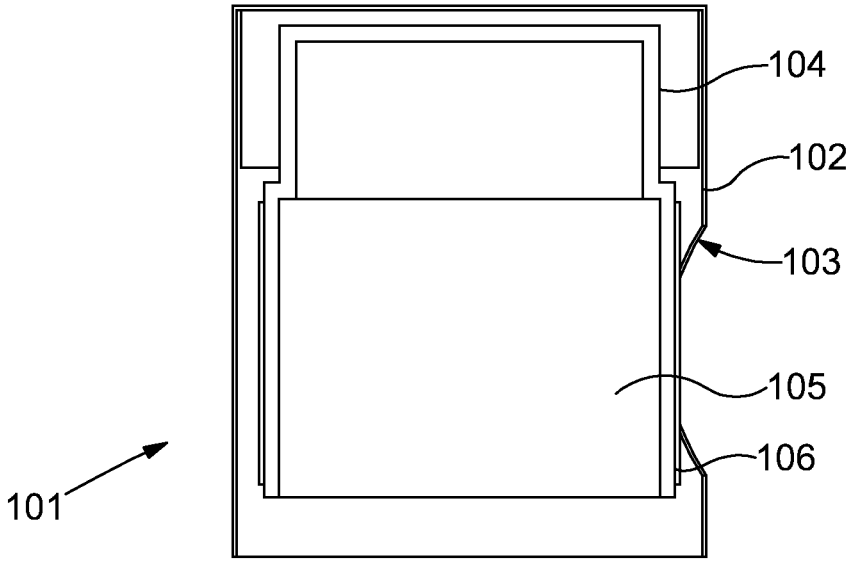
FIG. 2 shows an assembled schematic side view of the components of FIG. 1.

An assembled schematic side view of the shell 102, outer component 104, inner component 105 and sleeve 106 is shown in FIG. 2.

According to the shown arrangement, the outer component 104 is secured within the shell 102. In an example, the outer component 104 is adhered to the inside of the shell 102. Any suitable way of fixing the outer component 104 within the shell 102 may be used. In the arrangement shown in this Figure, the outer component 104 is located at the top of the shell 102.

In addition, according to the shown arrangement, the sleeve 106 is secured to inner component 105. In an example, the sleeve 106 is adhered to the outside of the inner component 105. Any suitable way of fixing the sleeve 106 around the inner component 105 may be used. In the arrangement shown in this Figure, the sleeve 106 tightly surrounds the inner component 105. The sleeve 106 may be located within a recessed region of the external surface of the inner component 105, and the external surface of the sleeve 106 may then be flush with the external surface of the inner component 105.

As can be seen in this Figure, the tamper-evident closure 101 is arranged such that a view of the sleeve 106 is visible through the window 103.

In the shown arrangement, the outer component 104 is rotatable around the inner component 105.

In this embodiment, a first portion of the tamper-evident closure 101 comprises inner component 105 and sleeve 106 and a second portion of the tamper-evident closure 101 comprises shell 102 and outer component 104.

It is to be appreciated that with the shell 102 and outer component 104 in fixed relative relation and with the sleeve 106 and inner component 105 also in fixed relative relation, rotation of the shell 106 causes rotation of the window 103 relative to the sleeve 106.

Thus, in this embodiment, rotation of the second portion 102, 104 relative to the first portion 105, 106 causes rotation of the window 103 relative to the first portion 105, 106.

As will be described in further detail below, the second portion 102, 104 is rotatable relative to the first portion 105, 106 upon first opening of the tamper-evident closure 101, in a first direction of rotation, from a first position in which the first and second portions 105, 106; 102, 104 are in a first relative relation to a second position in which the first and second portions 105, 106; 102, 104 are in a second relative relation, and the tamper-evident closure 101 comprises a locking mechanism for irreversibly locking the first portion and second portions 105, 106; 102, 104 in the second relative relation.

Figure 3:
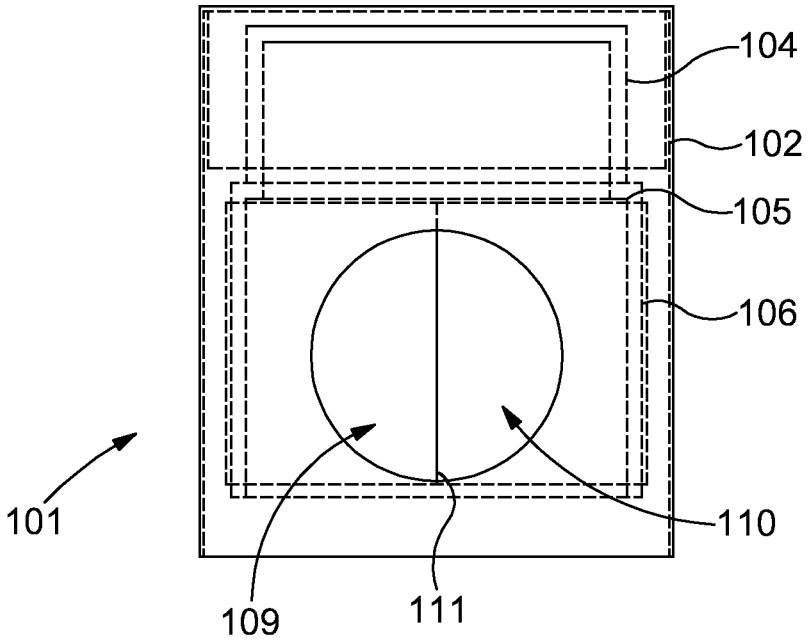
FIG. 3 shows an assembled schematic front view of the components of FIG. 1.

An assembled schematic front view of the shell 102, outer component 104, inner component 105 and sleeve 106 is shown in FIG. 3. It can be seen clearly from this Figure that a view of the first portion 105, 106 of the tamper-evident closure 101 is visible through the window 103 of the second portion 102, 104. A view of the sleeve 106, which in this specific illustration comprises both a region of the first zone 109 and a region of the second zone 110, is visible through the window 103 of sleeve 102.

The tamper-evident closure 101 is arranged such the view of the first portion that is visible through the window 103 of the second portion irreversibly changes during first opening of the tamper-evident closure 101.

In the present embodiment, the change in the view that is visible through the window 103 comprises a change of colour.

In this example, the first zone 109 of the sleeve 106 presents a first colour presentation and the second zone 110 of the sleeve 106 presents a second colour presentation that is different from the first colour presentation. In this specific example, the first zone 109 presents a yellow colour and the second zone 110 presents a red colour. Any combination of single colour zones, mixed colour zones or a combination thereof may be used. In this specific example also, there is a distinct transition boundary 111 between the two different colours of the first and second zones 109, 110. In an alternative example, there is a smooth, blended transition between the colours. The transition from one region, area or zone to another may be sharp or blurred, and different transition types may be used between different regions, areas or zones.

Figure 4:
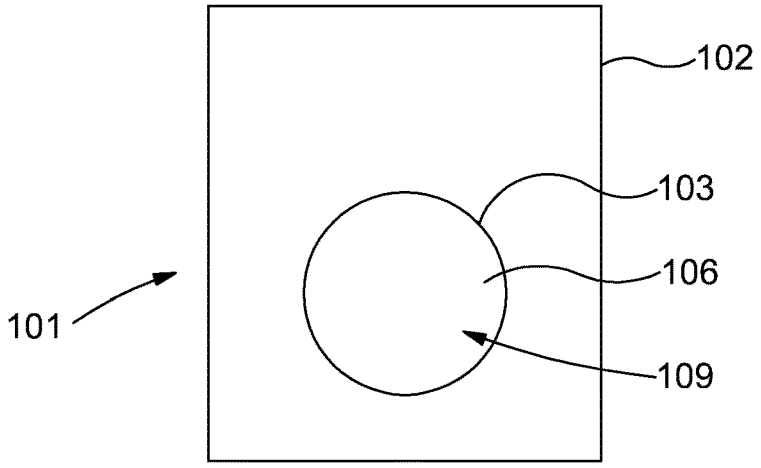
FIG. 4 shows the tamper-evident closure of FIGS. 1 to 3 prior to first opening.

FIG. 4 shows tamper-evident closure 101 prior to first opening. Before the tamper-evident closure 101 has been opened for the first time, the first and second portions of the tamper-evident closure are in a first relative relation and a first view of the first portion is visible through the window 103. In this illustrated example, when the first and second portions are in the first relative relation, the view of the first portion that is visible through the window 103 of the shell 102 comprises only a region of the first zone 109 of the sleeve 106. In this specific example, the colour yellow is therefore showing in the window 103.

To open the tamper-evident closure 101, the shell 102 is rotated in an anti-clockwise direction. This causes the window 103 to be rotated around sleeve 106.

Figure 5:
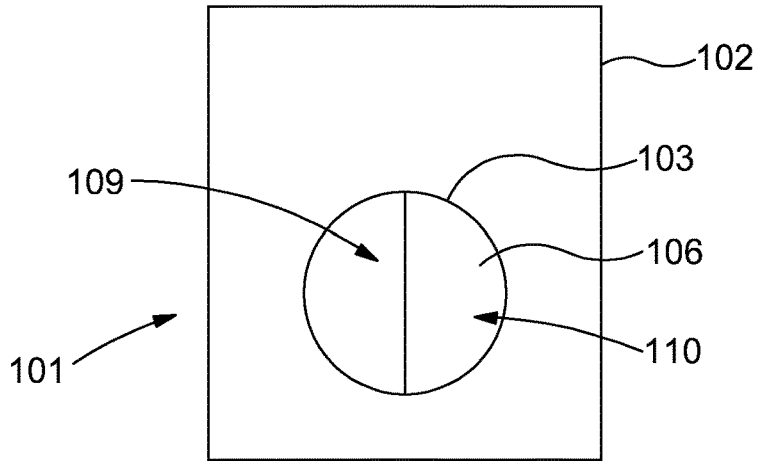
FIG. 5 shows the tamper-evident closure of FIGS. 1 to 3 at a first stage during first opening.

FIG. 5 shows tamper-evident closure 101 at a first stage during first opening. At the shown first stage, the shell 102 has been rotated from the first position shown in FIG. 4, in which the first and second portions are in a first relative relation before opening of the tamper-evident closure 101, towards a second position, in which the first and second portions are in a second relative relation. In FIG. 5, the shell 102 is shown at an intermediate position, between the first position and the second position.

It can be seen from comparison of FIG. 5 with FIG. 4 that the view of the first portion that is visible through the window 103 has changed, following the change of position of the shell 102.

In this illustrated example, the view of the first portion that is visible through the window 103 of the shell 102, following rotation of the shell to the intermediate position shown in FIG. 5, comprises a region of the first zone 109 of the sleeve 106 and also a region of the second zone 110 of the sleeve 106. In this specific example, both the colours yellow and red are therefore showing in the window 103.

Figure 6:
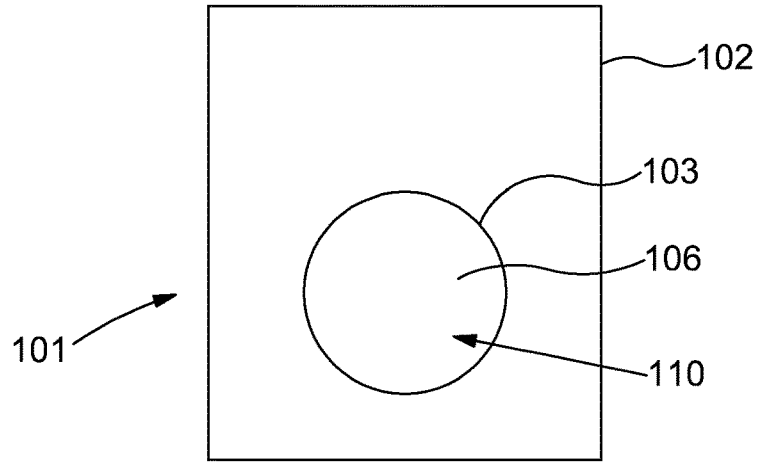
FIG. 6 shows the tamper-evident closure of FIGS. 1 to 3 at a second, subsequent stage during first opening.

FIG. 6 shows tamper-evident closure 101 at a second, subsequent stage during first opening. At the shown second stage, the shell 102 has been rotated from the intermediate position shown in FIG. 4, into the second position, in which the first and second portions are in a second relative relation.

It can be seen from comparison of FIG. 6 with FIG. 5 that the view of the first portion that is visible through the window 103 has changed again, following the change of position of the shell 102.

In this illustrated example, the view of the first portion that is visible through the window 103 of the shell 102, following rotation of the shell 102 to the second position shown in FIG. 6, comprises only a region of the second zone 109 of the sleeve 106. In this specific example, the colour red is therefore showing in the window 103.

Thus, during first opening of the tamper-evident closure 101, the view through the window 103 changes from a first colour presentation, in this specific example yellow, to a second colour presentation, in this specific example red. It is to be appreciated that any combination of colours may be used and also that additionally or alternatively to colour, alphanumeric text, graphics, patterns, pictures, surface finishes and/or textures may be used to provide or contribute to the changing view. More than one different view may be shown during the opening of the tamper-evident closure. By way of example, the view may change from red, to orange, to green during first opening. By way of further example, the view may comprise stripes that change in spacing and/or thickness and/or colour during first opening.

The use of the window and a view that changes during the initial opening of the closure provides a simple and effective form of tamper-evidence. It is to be appreciated that there may be two or more than two different stages in the change of appearance during the opening event of the tamper-evident closure.

As mentioned previously, the tamper-evident closure 101 comprises a locking mechanism for irreversibly locking the first and second portions in the second relative relation and, in turn, irreversibly locking the corresponding second view of the first portion in the window 103.

In this embodiment, the first and second portions of the tamper-evident closure 101 together form a cap, the locking mechanism irreversibly locks the first portion and the second portion in the second relative relation and thereafter the first and second portions are removable together.

According to the arrangement of tamper-evident closure 101:

Before the cap is opened:

The initial first (yellow) colour will be visible (indicating that the cap has not been opened or tampered with)

Once the cap opening sequence begins:

The shell 102 rotates around the sleeve 106 to obscure the initial first (yellow) colour and reveal the subsequent second (red) colour;

The inner and outer components engage to lock the first and second portions of the cap together;

The cap can be removed with the second (red) colour now showing instead of the initial first (yellow) colour (indicating that the cap has been opened);

The cap can be replaced and closed and the second (red) colour will remain showing (indicating that the cap has been opened at least once).

In this illustrated example, shell 102 and sleeve 106 are fabricated from aluminium, and outer component 104 and inner component 105 are fabricated from a plastics material.

It is to be appreciated that each of the first portion and the second portion of the tamper-evident closure may comprise any number of components, each of which may comprise one or more elements. Each part of the tamper-evident closure may be fabricated from any suitable material or combination of materials and may be manufactured using any suitable method, process or technique or combination of any suitable combination thereof. It is to be appreciated that the first portion may comprise or be formed as a single component and/or the second portion comprise or be formed as a single component.

In addition, the tamper-evident closure may be provided with more than one window having a changing view on first opening. A plurality of windows may include windows of the same or different type. A plurality of windows may include windows that have a changing view of the same or different type.

Figure 7:
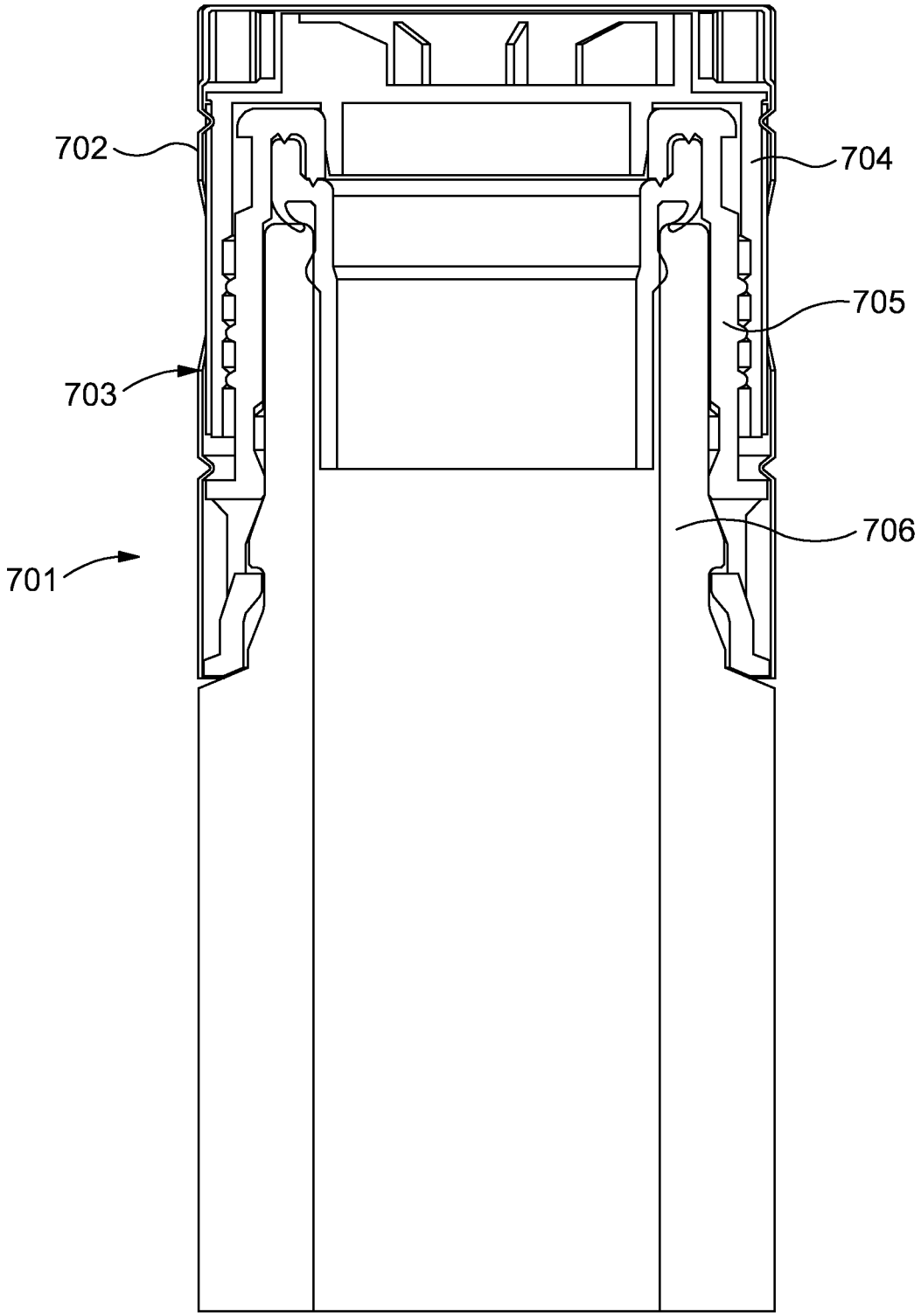
FIG. 7 shows features of a locking mechanism.

FIG. 7 illustrates features of a locking mechanism usable in a closure provided with the changing view tamper-evidence feature described above.

The locking mechanism is shown as part of a tamper-evident closure 701. Similar to tamper-evident closure 101, tamper-evident closure 701 comprises a shell 702 in which a window 703 is defined, an outer component 704 and an inner component 705. The tamper-evident closure 701 is shown fixed to a container neck 706.

In this embodiment, a first portion of the tamper-evident closure 701 comprises inner component 705 and a second portion of the tamper-evident closure 701 comprises shell 702 and outer component 704.

In an embodiment, the first portion is removably engageable with a body portion of the closure for fixing to a container neck. Alternatively, the first portion is removably engageable with the container neck. The first portion may therefore be indirectly or directly fixed to a container neck.

In an example, a body portion of the closure comprises a pouring fitment. In an example, the pouring fitment comprises a non-return valve.

As will be described in further detail, the locking mechanism comprises a ratchet arrangement. In this embodiment, the locking mechanism comprises an inner ratchet element and an outer ratchet element, the first portion comprises the inner ratchet element and the second portion comprises the outer ratchet element.

In the shown arrangement, the first portion comprises inner component 705 and the second portion comprises shell 702 and outer component 704. In this specific example, inner component 705 is provided with the inner ratchet element and outer component 704 is provided with the inner ratchet element.

Figure 8:
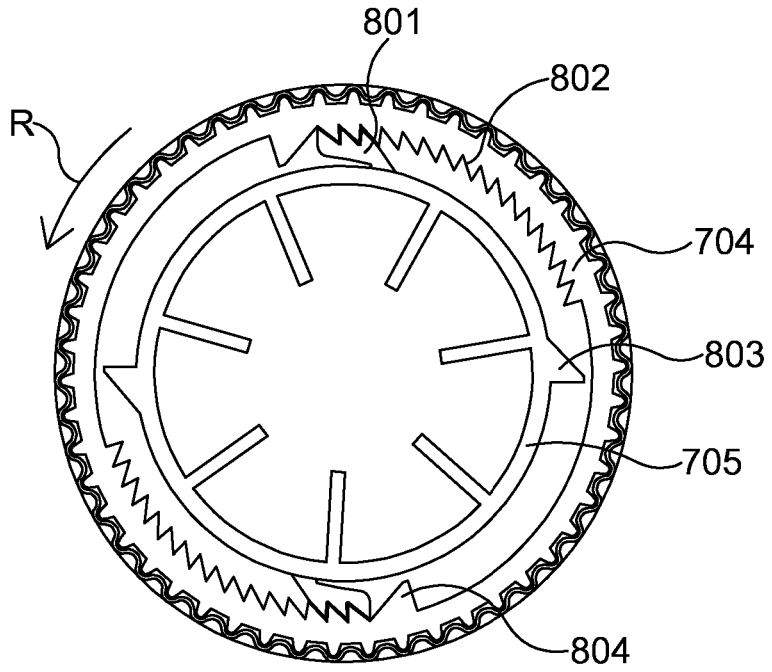
FIG. 8 illustrates the locking mechanism of FIG. 7 in a first condition.
Figure 9:
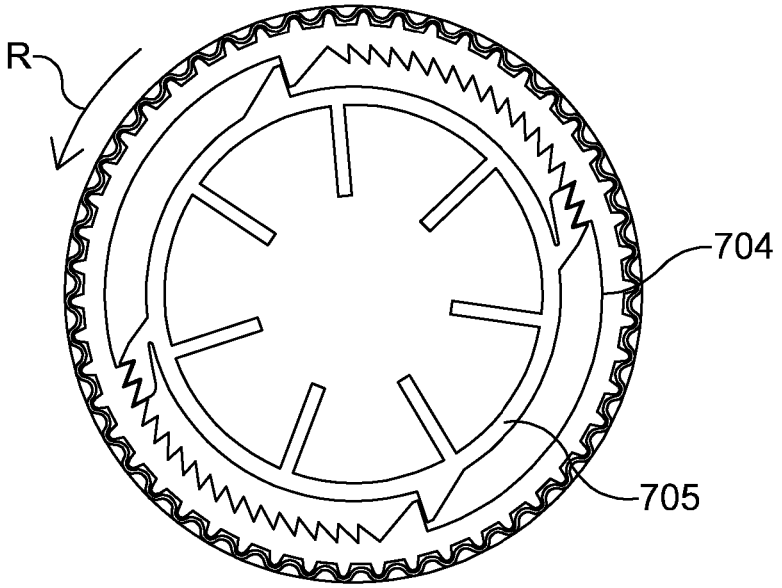
FIG. 9 illustrates the locking mechanism of FIG. 8 in a first condition.

Interengagement between the inner component 705 and the outer component 704 of tamper-evident closure 701 is illustrated in FIGS. 8 and 9.

FIG. 8 illustrates the locking mechanism prior to first opening of the closure. In this Figure, the locking mechanism is shown in a first condition in which the inner and outer components 705, 704 are in a first relative relation. As shown, the inner component 705 comprises first ratchet teeth 801 and the outer component 704 comprises second ratchet teeth 802. In addition, the inner component 705 comprises at least one first ratchet stop 803 and the outer component 704 comprises at least one second ratchet stop 804.

The outer component 704 is shown in a first position in FIG. 8, prior to first opening of the tamper-evident closure 701. During first opening, the outer component 704 is rotated in the opening direction R. The outer component 704 rotates around the inner component 705, and the second ratchet teeth 802 of the outer component ratchet along the first ratchet teeth 801 of the inner component 705. The ratchet engagement between the first and second ratchet teeth 801, 802 prevents the outer component 704 being rotated in the reverse direction, this being the direction of rotation opposite to the opening direction R.

Rotation of the outer component 704 around the inner component 705 from the first position is allowed until a second position is reached, after which the outer component 704 cannot be rotated further relative to the inner component 705.

FIG. 9 illustrates the locking mechanism following initial opening of the closure. In this Figure, the locking mechanism is shown in a second condition in which the inner and outer components 705, 704 are in a second relative relation and the outer component 704 is in a second position.

The outer component 704 is shown having been rotated around the inner component 705 until a second ratchet stop 804 of the outer component 704 has abutted against a first ratchet stop 803 of the inner component 705. The first and second ratchet stops 803, 804 provide an end point to the extent that the outer component 704 can rotate around the inner component 705 from the first position to the second position. In the second condition, the inner and outer components 704, 705 are locked together by the interaction of the first and second ratchet elements of the locking mechanism. The first and second ratchet stops 803, 804 prevent further rotation of the outer component 704 relative to the inner component 705 in the opening direction R and the first and second ratchet teeth 801, 802 prevent reverse rotation of the outer component 704 relative to the inner component 705.

According to the tamper-evident closure 701, during first opening, the shell 702 and the outer component 704 fixed within are rotated around the inner component 705 until the locking mechanism activates and irreversibly locks the first portion and the second portion together, after which continued rotation causes the first and second portions to be together removable from the container neck 706.

Figure 10:
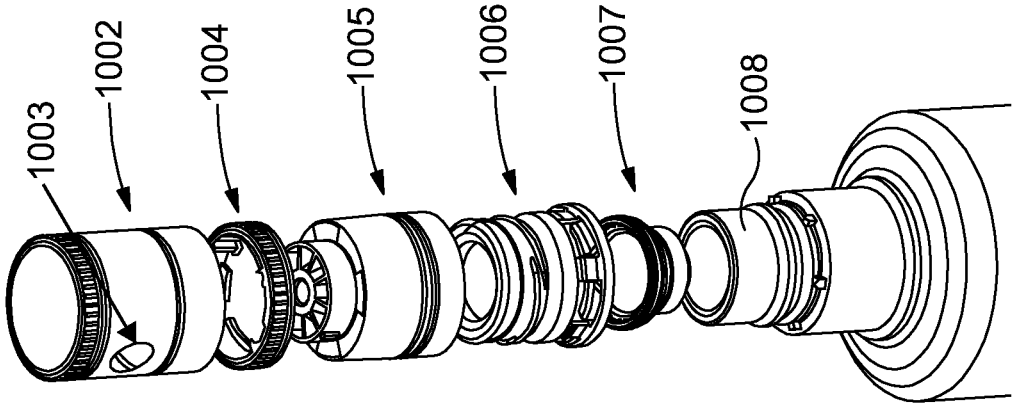
FIG. 10 shows a further tamper-evident closure.
Figure 10:
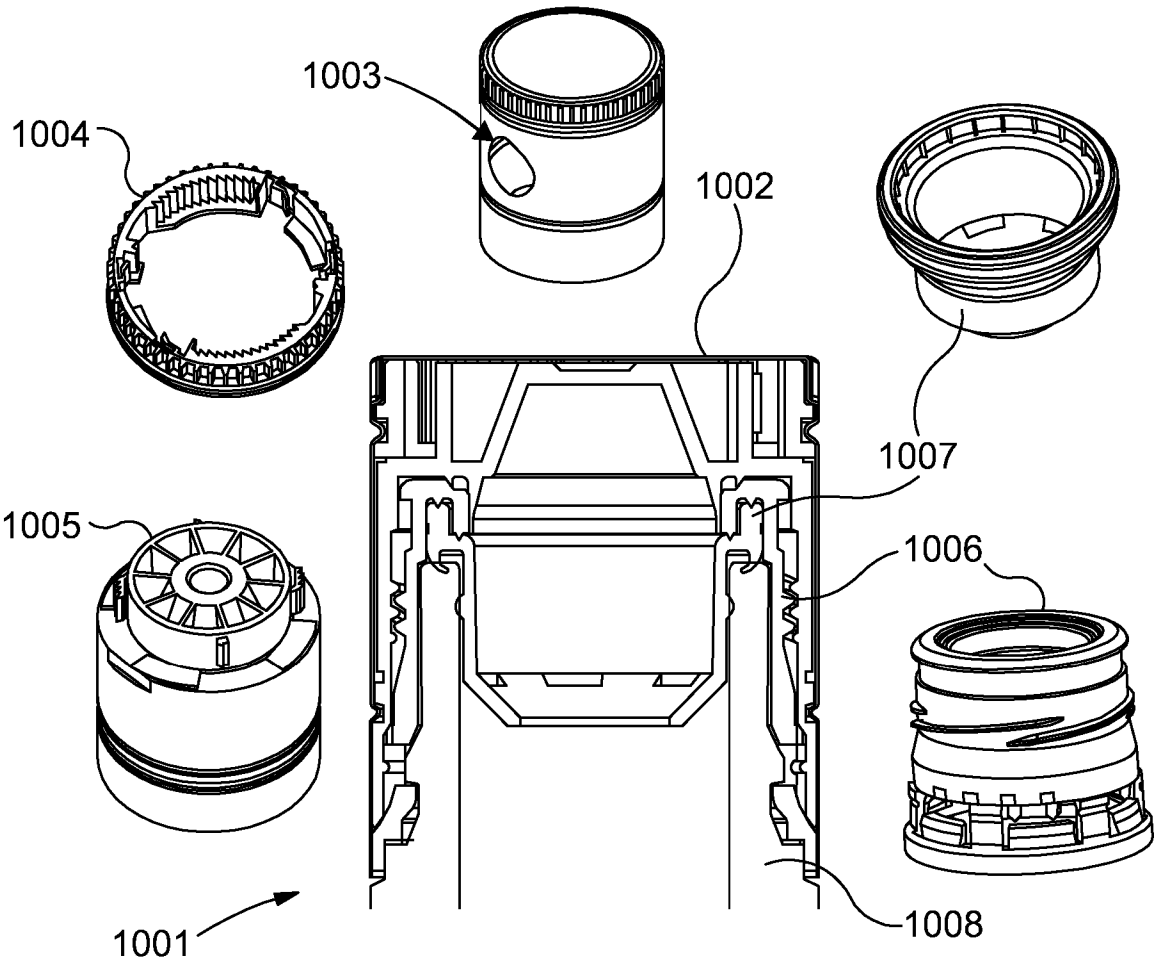

A further embodiment of a tamper-evident closure 1001 is shown in FIG. 10.

Similar to tamper-evident closure 101, tamper-evident closure 1001 comprises a first portion and a second portion comprising a window through which a view of the first portion is visible. The tamper-evident closure 1001 comprises a shell 1002 in which a window 1003 is defined, an outer component 1004 and an inner component 1005. According to this example, the first portion comprises the inner component 1005 and additionally comprises a body 1006 and a bucket 1007, for fixing to a container neck 1008. The second portion comprises shell 1002 and outer component 1004. Unlike the tamper-evident closure 101, in which the view of the first portion through the window 103 comprises a view of the sleeve 106 that is located around the inner component 105, according to tamper-evident closure 1001 the view of the first portion through the window 1003 comprises a view of the inner component 1005. The inner component 1005 may be foiled, sprayed or coated or may otherwise carry a visual presentation that provides the first and second different views that are visible through the window 1003 before and after first opening of the closure.

Figure 11:
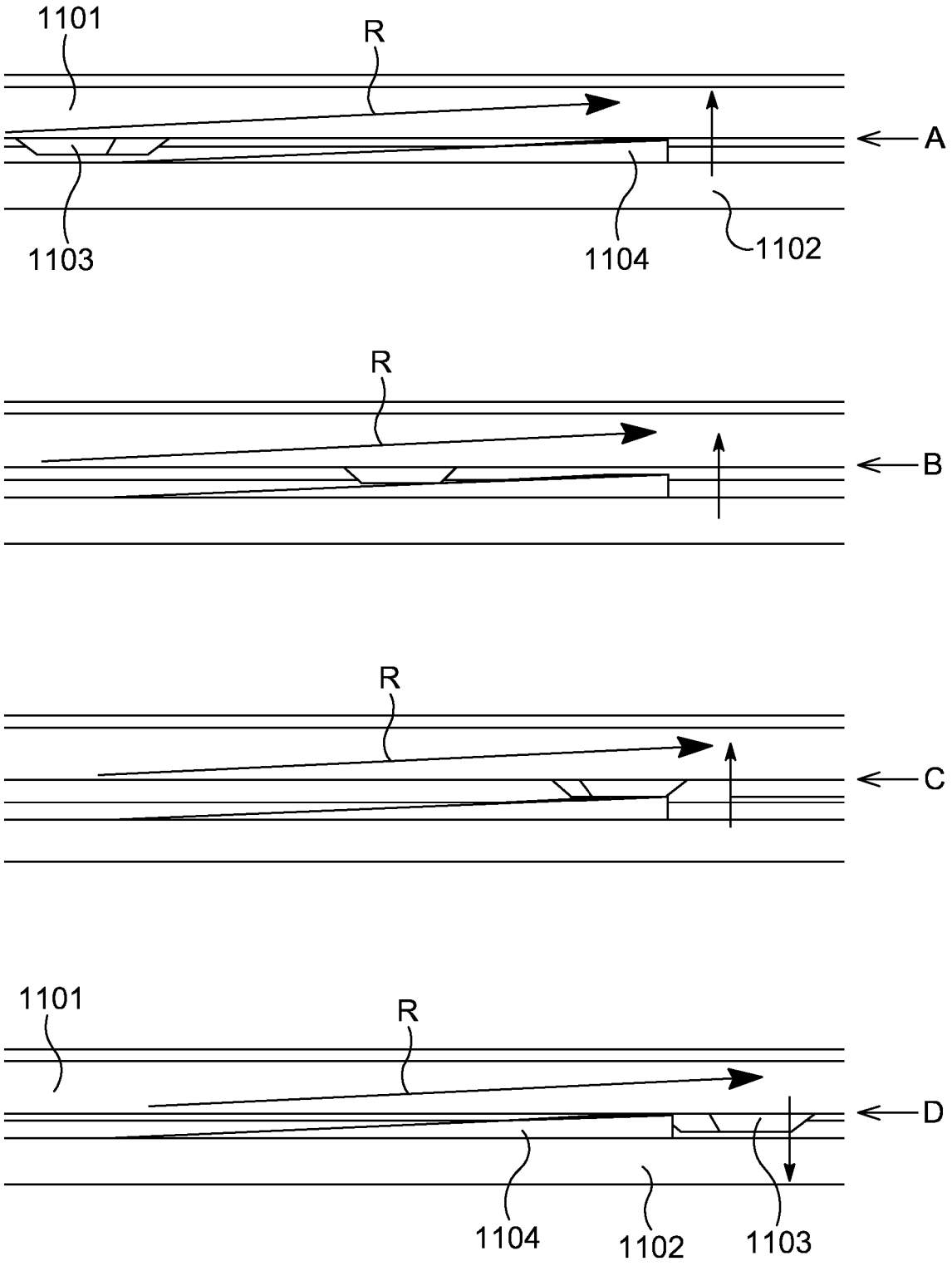
FIG. 11 shows features of a gap generating mechanism.

Features of a gap generating mechanism usable in a closure with a changing view tamper-evident feature as described herein are shown in FIG. 11.

A first part 1101 is rotatable in an opening direction of rotation R relative to a second part 1102. The first part 1101 comprises a downwardly extending lug 1103 and the second part 1102 comprises an upwardly extending ramp 1104 that is inclined to rise vertically in the direction of rotation R. As the first part 1101 is rotated in the direction of rotation R, the lug 1103 rides up the ramp 1104 of the second part 1102, as illustrated at A and B, causing the first part 1101 to move vertically away from the second part 1102. As rotation is continued, the lug 1102 reaches the end of the ramp 1104, as illustrated at C, after which it can drop down, as illustrated at D, allowing the first part 1101 to descend back towards the second part 1102. This gap generating mechanism can be used in a closure having a metal shell provided with frangible bridges or a line of weakness, to cause one shell part to be raised relative to another shell part during first opening of the closure to create a separation between those shell parts that assists the breaking of the frangible bridges or line or weakness and then assists the loosening of tension in the shell.

The first part 1101 may be included in the second portion of the closure and the second part 1102 may be included in the first portion of the closure.

Figure 12:
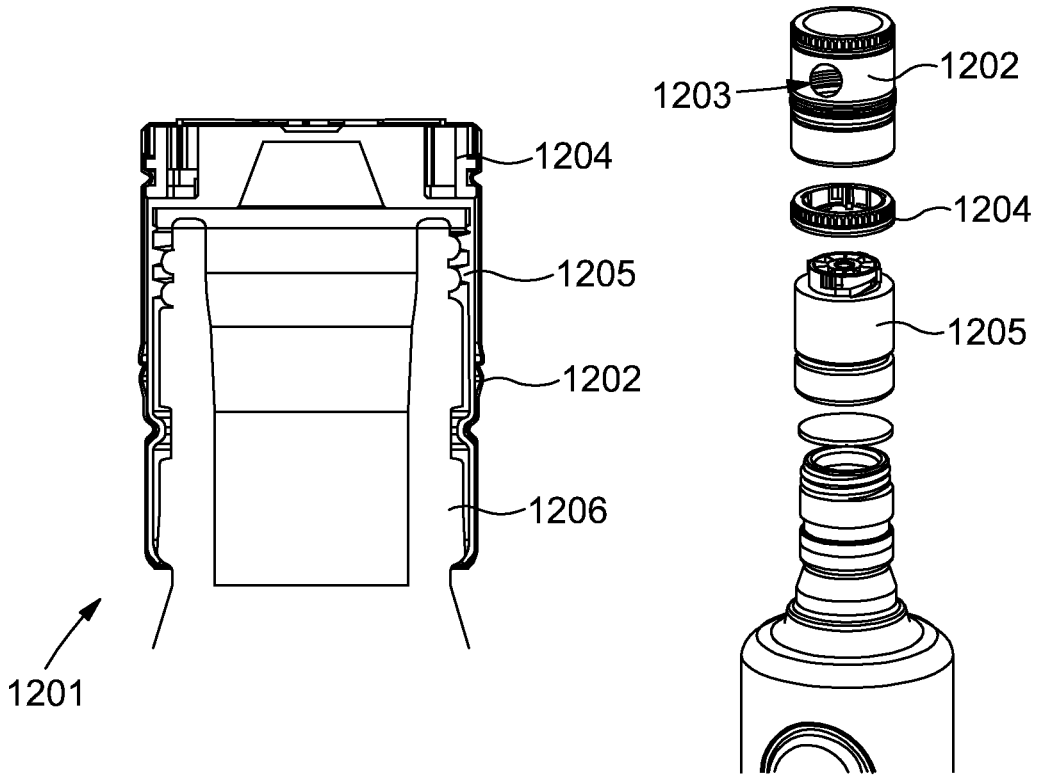
FIG. 12 shows features of another tamper-evident closure.
Figure 13:
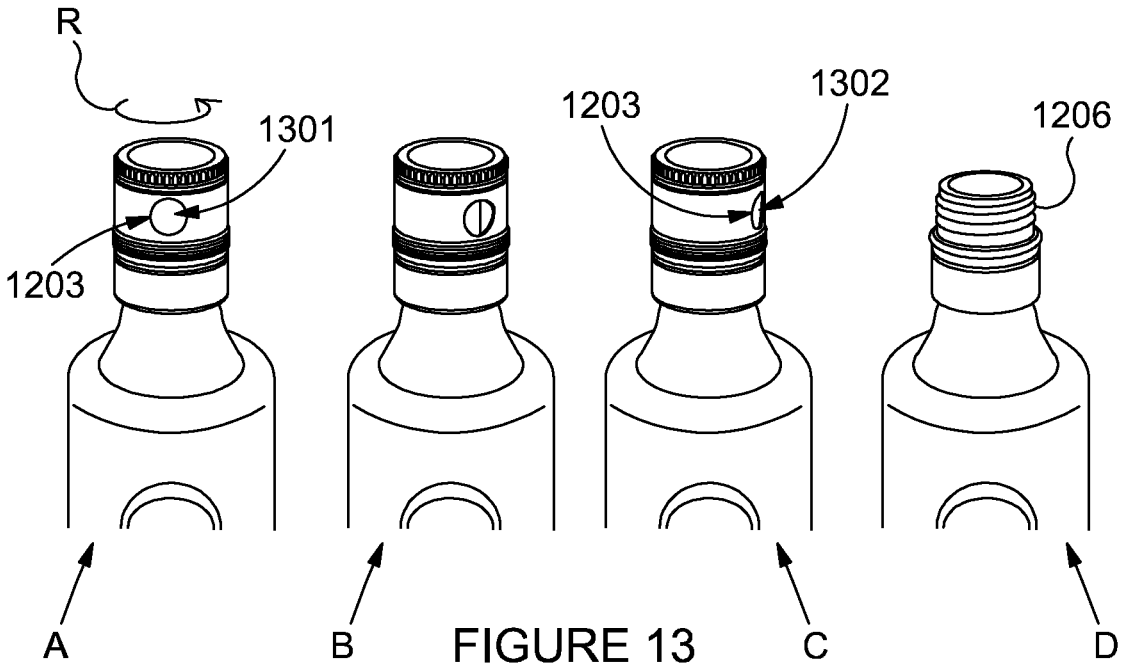
FIG. 13 shows steps in an opening sequence of the tamper-evident closure of FIG. 12.

FIG. 12 shows features of a further tamper-evident closure 1201, and steps in the opening sequence of the tamper-evident closure 1201 are shown in FIG. 13.

As can be seen from FIG. 12, the tamper-evident closure 1201 comprises a shell 1202 defining a window 1203, an outer ratchet component 1204 and an inner ratchet component 1205. The tamper-evident closure 1201 is shown fixed to a container neck 1206.

Referring to FIG. 13, at A, the tamper-evident closure 1201 is shown prior to first opening. A first view 1301 is visible through window 1203 of shell 1202. To initiate opening of the tamper-evident closure 1201, the shell 1202 is rotated in the direction of rotation R. At B, the tamper-evident closure 1201 is shown after an initial period of rotation of the shell 1202, and it can be seen that the view through the window 1203 of the shell 1202 has started to change. At C, the tamper-evident closure 1201 is shown after a further period of rotation of the shell 1202 has resulted in the inner and outer ratchet components 1204, 1205 becoming locked together and the view through the window 1203 of the shell 1202 having changed to a second view 1302 that is visually distinctly different from the first view 1301. At D, the shell 1202, complete with the locked together inner and outer ratchet components 1204, 1205 has been removed from the container neck 1206. The shell 1202, together with the inner and outer ratchet components 1204, 1205, can subsequently be replaced; however the second view 1302 will remain showing in the window 1203.

In some embodiments an irreversible gap generation mechanism may be included. The irreversible gap generation mechanism may comprise a ratchet arrangement. It is to be appreciated that a tamper-evident closure as described herein may comprise a lateral and/or a longitudinal ratchet arrangement.

In an embodiment, the tamper-evident closure comprises a first part and a second part, when the first and second portions are in the first relative relation, prior to first opening of the tamper-evident closure, the first and second parts are adjacent one another, and when the first and second portions are moved into the second relative relation, during first opening of the tamper-evident closure, an irreversible gap is generated between the first and second parts.

In an example, the first and second parts are lower and upper shell parts.

In a preferred example, the gap is an unobstructed gap. In other words, two parts of the closure are held apart without the requirement an obstruction trapped or otherwise held between them. In an alternative example, the gap is an obstructed gap.

Figure 14:
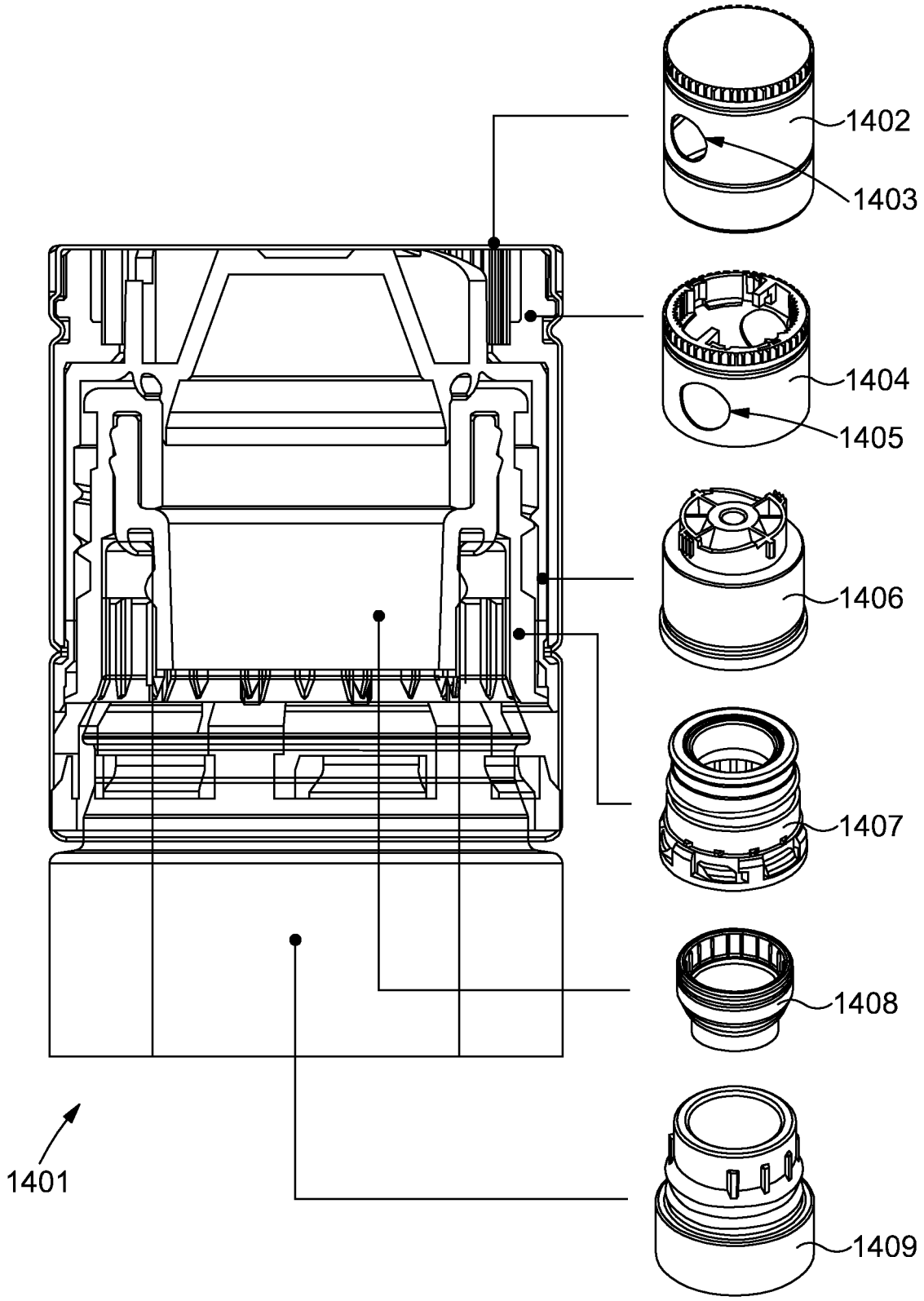
FIG. 14 shows features of a further tamper-evident closure.
Figure 15:
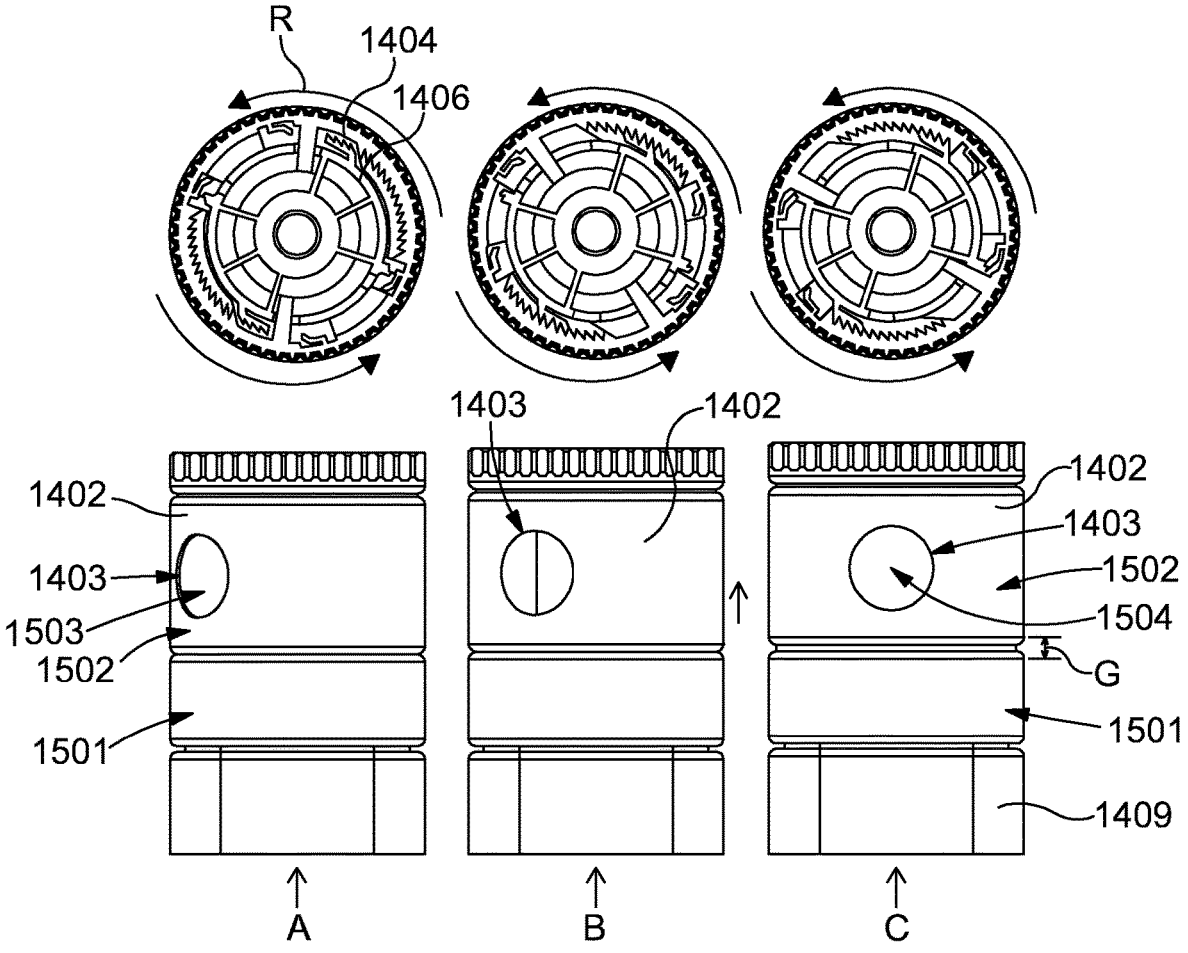
FIG. 15 steps in an opening sequence of the tamper-evident closure of FIG. 14.

Another embodiment of tamper-evident closure 1401 is shown in FIGS. 14 and 15. The tamper-evident closure 1401 has both a changing view tamper-evident feature as described above and an irreversible gap generation feature as described above.

The arrangement of tamper-evident closure 1401 includes a shell 1402 comprising a window 1403, an outer ratchet component 1404 comprising a window 1405 that corresponds to the window 1403 of the shell 1402 and an inner ratchet component 1406. The arrangement also optionally comprises a body 1407 and a bucket 1408. This Figure also shows a container neck finish 1409.

A first portion of the tamper-evident closure 1401 includes the shell 1402 and the outer ratchet component 1404, which are fixed together, with the respective windows 1403, 1404 aligned. The second portion of the tamper-evident closure 1401 includes at least the inner ratchet component 1405.

Stages in the opening of the tamper-evident closure 1401, during which the view through the window 1403 irreversibly changes and an irreversible gap is generated are shown in FIG. 15.

As can be seen in FIG. 15, the shell 1402 of the tamper-evident closure 1401 comprises a lower shell part 1501 and an upper shell part 1502.

The tamper-evident closure 1401 is shown prior to first opening at A. It can be seen that the upper shell part 1502 is initially adjacent the lower shell part 1501. The upper shell part 1502 and lower shell part 1501 may be joined along a line of weakness. In addition, a first view 1503 is visible through the window 1403 of the shell 1402.

To initiate opening of the tamper-evident closure 1401, the shell 1402 is rotated in the opening direction R. At B, the position of the shell 1402 has changed. In addition, vertical separation of the upper shell part 1502 from the lower shell part 1501 has begun. Further, in this example, the view through the window 1403 has altered.

At C, the shell 1402 has been rotated further to a position in which the inner and outer ratchet components 1404, 1406 have locked the first and second portions of the tamper-evident closure 1401 together. In addition, an irreversible gap G has been generated between the upper shell part 1502 and the lower shell part 1501. Further, the view through the window 1403 has irreversibly changed and a second view 1504 that is different from the first view 1503 is through the window 1403 of the shell 1402.

The shell 1402, together with the inner and outer ratchet components 1404, 1406, can now be removed from the container neck 1409, through continued rotation of the shell 1402 in the opening direction R. The second, different view 1503 remains in the window 1403 to indicate that the tamper-evident closure 1401 has been opened. When the shell 1402, with the inner and outer ratchet components 1404, 1406 is replaced, the gap G generated during first opening of the tamper-evident closure 1401 is again present between the shell 1402 and the lower shell part 1403. Thus, the tamper-evident closure 1401 has a first tamper-evident feature, in the form of the window with changing view, that is visible on the removable part and has a second tamper-evident feature, in the form of the gap, that is visible immediately before first removal of the removable part and also when the removable part has been replaced. In an embodiment, more than one irreversible gap is generated. A known gap generator mechanism may be utilised to generate each or the gap.

It is to be understood that a tamper-evident closure is provided by the present invention that comprises at least one tamper-evidence feature that activates during the natural motion of opening. More specifically, as the closure is rotated during opening, the view of the first portion through the window of the second portion irreversibly changes, and at least one irreversible gap may also be generated.

It is to be appreciated that the change of view in the or each window of the tamper-evident closure may be effected as a result of relative rotation of the first portion to the second portion in a single direction of movement (direction of rotation) or two directions of movement (direction of rotation and vertical direction). For example, the first portion may or may not lift or rise relative to the second portion during the phase of the initial opening event in which the view through the window is irreversibly changed.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims.

The invention claimed is:

1. A tamper-evident closure for a container neck, the tamper-evident closure comprising:

a cap, the cap comprising a first portion, a second portion and a locking mechanism; the first portion removably engageable with the container neck or a body portion of the tamper-evident closure for fixing to the container neck, to releasably fix the cap to the container neck, and the second portion comprising a window through which a view of the first portion is visible;

the second portion rotatable relative to the first portion upon first opening of the tamper-evident closure, in a first direction of rotation, from a first position in which the first and second portions are in a first relative relation to a second position in which the first and second portions are in a second relative relation; wherein the locking mechanism irreversibly locks the first portion and the second portion in the second relative relation and thereafter the first and second portions are removable together; and wherein rotation of the second portion relative to the first portion causes rotation of the window relative to the first portion, a first view of the first portion is visible through the window when the first and second portions are in the first relative relation, and a second, different view of the first portion is visible through the window when the first and second portions are in the second relative relation;

whereby the view of the first portion through the window of the second portion is irreversibly changed during first opening of the tamper-evident closure;

wherein the tamper-evident closure comprises a first part, and a second part, when the first and second portions are in the first relative relation, prior to first opening of the tamper-evident closure, the first and second parts are adjacent one another, and when the first and second portions are moved into the second relative relation, during first opening of the tamper-evident closure, an irreversible gap is generated between the first and second parts.

2. A tamper-evident closure as claimed in claim 1, wherein said first view comprises a first colour presentation and second, different view comprises a second, different colour presentation.

3. A tamper-evident closure as claimed in claim 1, wherein the second portion comprises a shell in which the window is defined.

4. A tamper-evident closure as claimed in claim 3, wherein the shell comprises a top plate and a side skirt and the window is defined in the side skirt.

5. A tamper-evident closure as claimed in claim 4, wherein the window is one of: an aperture, a cut-out.

6. A tamper-evident closure as claimed in claim 3, wherein the shell comprises aluminium.

7. A tamper-evident closure as claimed in claim 3, wherein the first portion comprises a sleeve comprising a first zone having a first appearance and a second zone having a second appearance that differs from the first appearance.

8. A tamper-evident closure as claimed in claim 7, wherein the sleeve comprises aluminium.

9. A tamper-evident closure as claimed in claim 1, wherein the locking mechanism comprises a ratchet arrangement.

10. A tamper-evident closure as claimed in claim 9, wherein the locking mechanism comprises an inner ratchet element and an outer ratchet element, the first portion comprises the inner ratchet element and the second portion comprises the outer ratchet element.

11. A tamper-evident closure as claimed in claim 1, wherein the first and second parts are lower and upper shell parts.

12. A tamper-evident closure as claimed in claim 1, wherein the gap is unobstructed.

13. A tamper-evident closure as claimed in claim 1, wherein the window comprises more than one opening.

14. A container comprising a container neck provided with a tamper-evident closure, the tamper-evident closure as claimed in claim 1.

* * * * *